US007204050B2

(12) United States Patent
Molokotos et al.

(10) Patent No.: US 7,204,050 B2
(45) Date of Patent: Apr. 17, 2007

(54) EXIT DEVICE WITH LIGHTED TOUCHPAD

(75) Inventors: Thanasis Molokotos, Easton, CT (US); Daniel J Picard, Oakville, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 10/748,622

(22) Filed: Dec. 29, 2003

(65) Prior Publication Data

US 2005/0144822 A1 Jul. 7, 2005

(51) Int. Cl.
*G09F 13/04* (2006.01)

(52) U.S. Cl. ..... 40/570; 40/544; 40/580; 292/93; 362/812

(58) Field of Classification Search ..... 40/570, 40/464, 442, 452, 541, 544, 564, 580; 292/92, 292/93, 336.3; 340/815.45, 815.48; 345/46, 345/82, 173; 446/175; 362/100, 812
See application file for complete search history.

(56) References Cited

U.S. PATENT DOCUMENTS

| | | | | | |
|---|---|---|---|---|---|
| 1,898,505 | A | * | 2/1933 | Soemer | 292/92 |
| 2,732,237 | A | * | 1/1956 | Kihn et al. | 292/67 |
| 3,365,630 | A | * | 1/1968 | Logan et al. | 148/33 |
| 3,470,038 | A | * | 9/1969 | Logan et al. | 438/22 |
| 3,603,833 | A | * | 9/1971 | Logan et al. | 313/499 |
| 3,722,938 | A | | 3/1973 | Bauer et al. | |
| 3,725,749 | A | * | 4/1973 | Groves et al. | 257/87 |
| 3,811,717 | A | | 5/1974 | Floyd et al. | |
| 3,864,721 | A | * | 2/1975 | Cohen | 257/101 |
| 3,875,473 | A | * | 4/1975 | Lebailly | 257/90 |
| 4,007,954 | A | | 2/1977 | Erickson | |
| 4,167,280 | A | * | 9/1979 | Godec et al. | 292/92 |
| D268,003 | S | | 2/1983 | Ohno | |
| 4,384,738 | A | | 5/1983 | Floyd | |
| 4,420,898 | A | * | 12/1983 | Moses | 40/570 |
| 4,466,208 | A | * | 8/1984 | Logan et al. | 40/544 |
| 4,489,308 | A | | 12/1984 | Logan, Jr. et al. | |
| 4,534,743 | A | * | 8/1985 | D'Onofrio et al. | 445/24 |
| D290,442 | S | | 6/1987 | Floyd et al. | |
| 4,869,083 | A | | 9/1989 | DeMarseilles et al. | |
| 4,871,204 | A | * | 10/1989 | Cook et al. | 292/251.5 |
| 5,005,306 | A | * | 4/1991 | Kinstler | 362/486 |
| 5,019,748 | A | | 5/1991 | Appelberg | |

(Continued)

OTHER PUBLICATIONS http://www.sargentlock.com/products/exit/product_group.php.

*Primary Examiner*—Gary C. Hoge
(74) *Attorney, Agent, or Firm*—DeLio & Peterson, LLC

(57) ABSTRACT

An exit device includes an electroluminescent exit sign assembly, preferably mounted on a push rail actuator of the exit device. An electroluminescent illuminator, an opaque material and a transparent protective cover form the electroluminescent sign assembly. The push rail actuator operates a latch mechanism and opens an associated exit door when pressure is applied. An inverter may be located within the exit device to power the electroluminescent illuminator with an AC or voltage. The electroluminescent sign assembly is preferably removable for repair or replacement without removing the exit device from the exit door and is located within a surface cavity in an electrically insulating touchpad on the exit device actuator. Additional transparent nonconductive material surrounds the electroluminescent material to provide further electrical insulation.

19 Claims, 2 Drawing Sheets

U.S. PATENT DOCUMENTS 5,339,550 A 8/1994 Hoffman
5,412,544 A 5/1995 Derrick et al.
5,444,930 A * 8/1995 Loew ..... 40/544
5,475,998 A 12/1995 Raskevicius
5,566,384 A * 10/1996 Chien ..... 362/486
5,581,230 A 12/1996 Barrett
5,692,327 A * 12/1997 Wynne et al. ..... 40/205
5,775,016 A 7/1998 Chien
5,988,708 A * 11/1999 Frolov et al. ..... 292/92
5,992,195 A 11/1999 Huang et al.
6,135,621 A * 10/2000 Bach et al. ..... 362/399
6,178,794 B1 1/2001 Eller et al.
6,189,939 B1 * 2/2001 Zehrung ..... 292/92
6,240,665 B1 * 6/2001 Brown et al. ..... 40/570
6,249,221 B1 6/2001 Reed
6,431,733 B2 8/2002 Seifert et al.
6,565,130 B1 * 5/2003 Walsh, III ..... 292/92
6,698,118 B2 * 3/2004 Tietze et al. ..... 40/205
6,715,225 B1 * 4/2004 Frolov et al. ..... 40/570

* cited by examiner

EXIT DEVICE WITH LIGHTED TOUCHPAD

BACKGROUND OF THE INVENTION

1. Field of the Invention

The present invention relates to exit devices, of the type used to rapidly and reliably open exit doors and allow people to exit public buildings in the event of a fire, panic situation or other emergency. More particularly, the present invention relates to electrically illuminated exit devices.

2. Description of Related Art

An "exit device" is a lock mechanism operated from the inside of an outward swing door through the use of a crossbar, push bar or push rail actuator, that is designed to open an exit door, allowing exit without prior knowledge of how the lock operates, whenever a horizontal force is applied to the actuator. Exit devices are typically required by fire or building codes and are used in public buildings where many people may be gathered, to provide rapid, safe and easy egress in case of emergency.

Exit devices ensure that an exit door is free to operate from the inside of the locked area, yet they allow the exit door to remain locked to prevent unauthorized entry from the outside.

Although exit devices have been highly successful in performing the function for which they were designed, deaths in public building fires continue to occur. Some deaths can be traced to the inability of those within the building to quickly identify all the building exit doors when smoke from the fire obscures required exit signage. Such signage is typically located close to the ceiling of public rooms, which permits it to be seen over the heads of those within the room. However, this location is the first to become obscured when smoke and heated air from a fire rise to the ceiling in the room.

There remains a need to improve exit signage and to directly and rapidly signal to the public the location of each exit door and the location of the actuator for each exit door, particularly in low light or smoke-obscured conditions that accompany a fire.

Conventional illumination devices, which might meet this need, such as incandescent bulbs, are bulky, fragile, provide non-uniform illumination and produce excessive heat, all of which makes them unsuitable for installation in an exit device. An exit device is subject to repeated impact as the door is operated, so any illuminator located therein must be extremely rugged. The illuminator must not produce heat which could potentially burn a user touching metal components of the exit device, or which might present a fire hazard when the exit device is installed on a wooden door. The illuminator must be long lasting to minimize maintenance costs, yet it must reliably illuminate in an emergency situation.

SUMMARY OF THE INVENTION

Bearing in mind the problems and deficiencies of the prior art, it is therefore an object of the present invention to provide an exit device with an integrated illuminated sign assembly.

It is another object of the present invention to provide an exit device with an integrated illuminated sign assembly that is long lasting and impact resistant.

A further object of the invention is to provide an exit device with an integrated illuminated sign assembly that produces no heat and wherein the illuminated sign may be located directly on the exit device push bar or actuator.

The above and other objects, which will be apparent to those skilled in art, are achieved in the present invention which is directed to an illuminated exit device including a door latch mechanism, a base for attachment to a surface of a door, an actuator, a planar electroluminescent illuminator, a planar sign including opaque portions for blocking illumination from the electroluminescent illuminator, and a transparent protective cover mounted in front of the sign.

The illuminator, sign and covering plate form a sign assembly visibly mounted on the exit device. The actuator is movably mounted relative to the base and is connected to operate the latch mechanism when pressure is applied to thereto. The electroluminescent illuminator includes electrical wiring extending through the exit device for connection to a source of electrical power, either directly or through an inverter. The sign is mounted between the electroluminescent illuminator and the transparent cover.

The actuator may be a pushbar, push rail, push plate or other known type of exit device actuator. The latch mechanism may be of the type illustrated or it may be a hidden or visible vertical rod design or other known latch mechanism design, which will be familiar to those of skill in this field.

The sign assembly is preferably mounted on the actuator such that pressure applied directly to the illuminated sign assembly will operate the exit device. The sign assembly may be directly mounted on the actuator or it may be mounted on a touchpad mounted on the actuator. The touchpad may provide additional electrical insulation and may simplify removal, repair and replacement of the sign assembly and the components thereof.

The sign assembly is preferably mounted in a surface cavity in the touchpad with the transparent protective cover positioned flush with the surface of the touchpad. The electroluminescent illuminator is preferably encased in a transparent plastic which cooperates with the insulation formed by the touchpad to provide double electrical insulation between the electroluminescent illuminator and other parts of the exit device that may be contacted by the public when the exit device is used. The sign preferably includes the word "EXIT" and/or other verbage in English or other languages, appearing one or more times thereon.

The optional integrated inverter provides a high voltage AC power to the electroluminescent illuminator from a low voltage input to the inverter, the low voltage not presenting a shock hazard, and the high voltage being insulated from the other parts of the exit device. The low voltage for the inverter is preferably also a voltage suitable for driving electromechanical locks and hardware, such as 24 volts AC or DC. Most preferably the inverter is capable of operating from both AC and DC voltage.

The illuminated exit device is designed to permit removal of the transparent cover and/or the touchpad to permit replacement or repair of the electroluminescent illuminator.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–2 of the drawings in which like numerals refer to like features of the invention.

Figure 1:
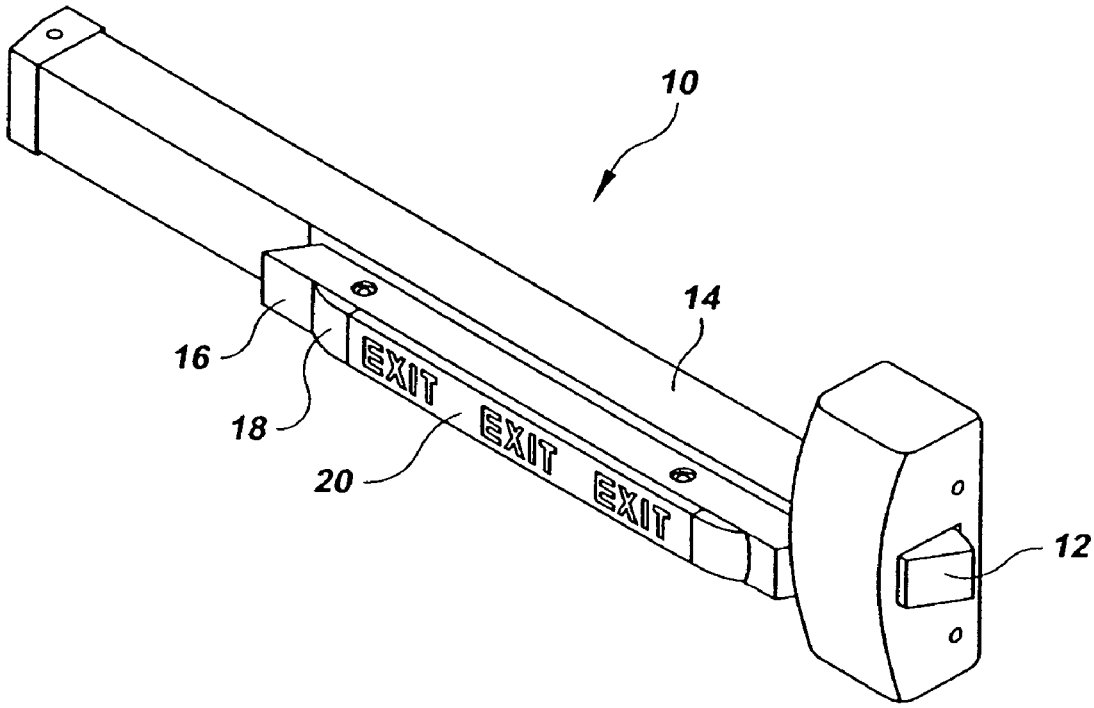
FIG. 1 is a perspective view of a fully assembled exit device according to the present invention adapted for installation on a right hand reverse bevel exit door.

Referring to FIG. 1, an illuminated exit device 10 includes a door latch mechanism 12, a base 14 for attachment to a surface of a door, and an actuator 16 movably mounted relative to the base and connected to operate the latch mechanism 12. When pressure is applied directly to the actuator 16, to the touchpad 18 or to an integrated electroluminescent sign assembly 20, the latch mechanism is operated to open the exit door.

Figure 2:
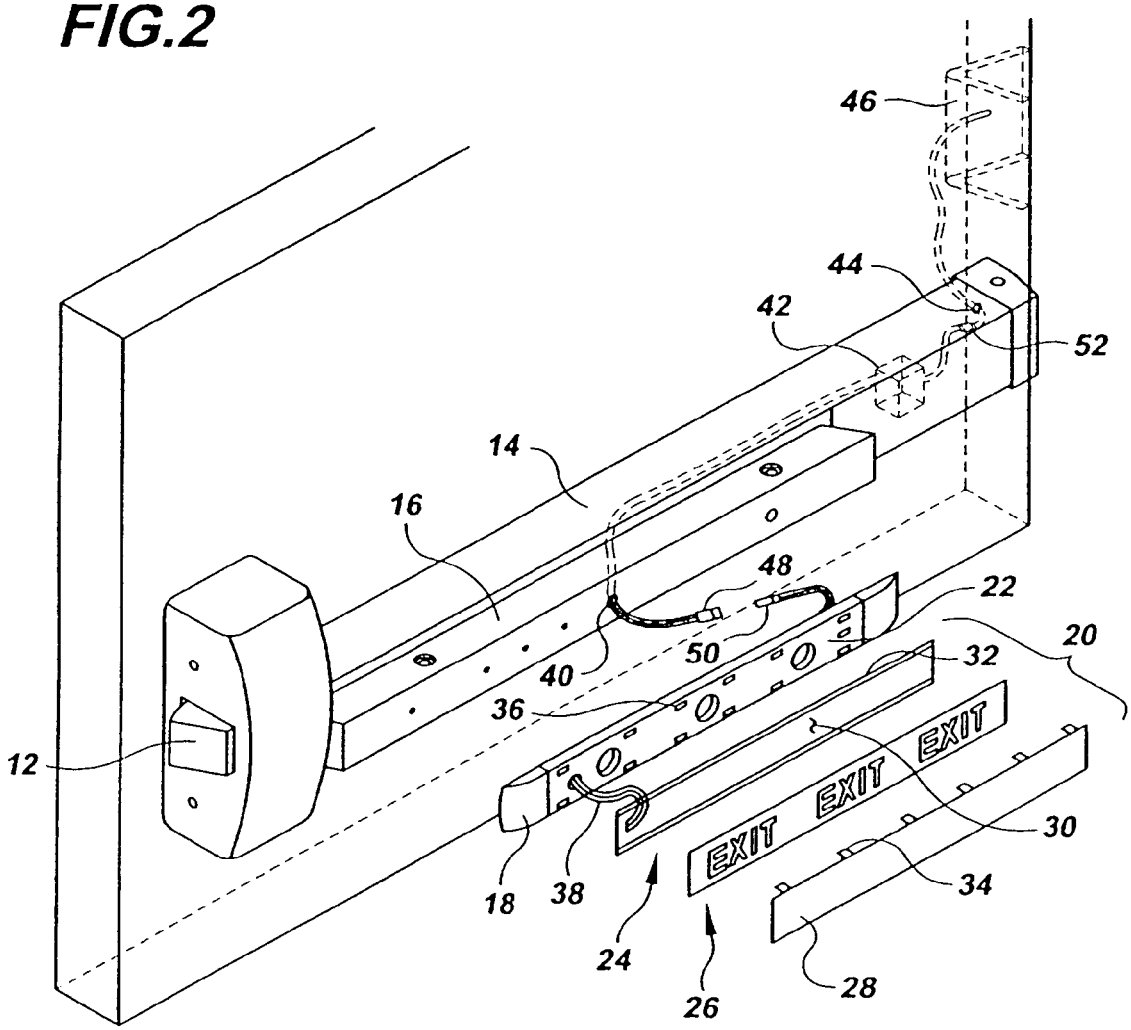
FIG. 2 is a perspective view of an exit device for a left hand reverse bevel exit door according to the present invention, with the sign assembly shown in exploded view format. The exit device is shown mounted on a door and wiring, an electric hinge and an inverter are shown in phantom.

Referring to FIG. 2, it can be seen that the actuator 16 is provided with a touchpad 18 having a surface cavity 22 formed therein for receiving the sign assembly 20. The sign assembly 20 is formed from a planar electroluminescent illuminator 24, a planar sign 26 having opaque portions to form the readable sign and a transparent protective cover 28.

The electroluminescent illuminator includes an electroluminescent material 30 preferably encased in a transparent electrically insulating material 32. The sign 26 may be a separate element or it may be a thin film adhesively attached to and integrated with the cover 28. Alternatively, it may be in the form of paint applied to the electroluminescent illuminator or the transparent cover. The opaque portions of the sign may form the lettering of the sign or the area around the lettering.

The touchpad 18 is preferably constructed of an electrically insulating plastic, which cooperates with the transparent coating 32 around the electroluminescent material 30 to provide double electrical insulation between the electroluminescent illuminator and other components of the exit device.

The cover 28 includes multiple tabs 34 which engage corresponding openings 36 in the surface cavity 22. Wiring 38 extends from the illuminator 30 through the touchpad 18, through an opening 40 in the actuator 16 to an optional inverter 42 located within the body of the exit device 14. Wiring 40 continues through an opening 44 into the door and through an electric hinge 46 and into the wall where connection is made to a source of power. An "electric hinge" is a commercially available product which allows electrical connections to be made through the hinge line of an exit door In the preferred design, the inverter 42 is powered with a low voltage AC or DC voltage which is also suitable for powering electromechanical locks and hardware. Alternatively, the inverter 42 may be omitted and a direct connection to a suitable power supply is provided.

The electroluminescent material 30 is typically provided with a 200 volt, 400 Hertz AC signal by the inverter 42. Connectors at 48 and 50 allow the touchpad and sign assembly to be disconnected without the necessity of removing the exit device from the door. Connector 52 allows the exit device to be connected to wiring from the electric hinge 46.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An illuminated exit device comprising:

a door latch mechanism;

a base for attachment to a surface of a door;

an actuator movably mounted relative to the base and connected to operate the door latch mechanism when pressure is applied to the actuator by a person desiring to operate the exit device;

a planar electroluminescent illuminator including electrical wiring extending through the exit device for connection to a source of electrical power;

a planar sign including opaque portions for blocking illumination from the electroluminescent illuminator, the sign being mounted in front of the electroluminescent illuminator;

a transparent protective cover mounted in front of the sign, the illuminator, sign and covering plate forming a sign assembly visibly mounted on the exit device; and a touchpad mounted on the actuator, the touchpad including a surface cavity in a surface thereof and the surface cavity including a plurality of openings, the transparent cover including a plurality of tabs, whereby the sign assembly is held in the surface cavity by engagement between the tabs of the transparent cover and the openings in the surface cavity.

2. The illuminated exit device according to claim 1 wherein the actuator comprises an elongated push bar.

3. The illuminated exit device according to claim 1 wherein the sign assembly is mounted on the actuator and pressure applied to the sign assembly will operate the exit device.

4. The illuminated exit device according to claim 1 further including a touchpad mounted on the actuator, and wherein the sign assembly is mounted on the touchpad.

5. The illuminated exit device according to claim 4 wherein the touchpad includes a surface cavity in a surface thereof and the sign assembly is mounted in the surface cavity with the transparent protective cover positioned flush with the surface of the touchpad.

6. The illuminated exit device according to claim 4 wherein the touchpad is formed of an electrically insulating material providing an electrically insulating barrier between the electroluminescent illuminator and other parts of the exit device.

7. The illuminated exit device according to claim 6 wherein the touchpad is formed of plastic.

8. The illuminated exit device according to claim 6 wherein the electroluminescent illuminator is encased in a transparent plastic comprising an additional electrical insulator to provide double electrical insulation between the electroluminescent illuminator and other parts of the exit device.

9. The illuminated exit device according to claim 1 wherein the planar sign comprises an opaque film adhesively attached to the transparent protective cover.

10. The illuminated exit device according to claim 9 wherein the planar sign comprises an opaque paint.

11. The illuminated exit device according to claim 1 wherein the sign includes letters forming the word "EXIT" and/or other verbage in English or other language thereon.

12. The illuminated exit device according to claim 1 wherein the electroluminescent illuminator is encased in a transparent plastic comprising an electrical insulator.

13. The illuminated exit device according to claim 1 wherein:

the base includes an opening facing towards the surface of the door on which the base is to be attached, and the electrical wiring is hidden from view within the exit device and extends from the electroluminescent illuminator to the opening in the base whereby the electroluminescent illuminator may be electrically connected to hidden power wiring in the door extending from an electrical hinge to an opening in the door surface, the opening in the base being located opposite the opening in the door surface to permit connection between the power wiring and the internal wiring.

14. The illuminated exit device according to claim 1 wherein the transparent cover is removable without removal of the exit device from the door to permit replacement or repair of the electroluminescent illuminator.

15. The illuminated exit device according to claim 1 further including an inverter for supplying power to the electroluminescent illuminator.

16. The illuminated exit device according to claim 15 wherein the inverter provides high voltage AC power to the electroluminescent illuminator from a low voltage which is suitable for driving electromechanical locks and hardware.

17. The illuminated exit device according to claim 15 wherein the inverter provides high voltage AC power to the electroluminescent illuminator from a 24 volts AC or DC power input to the inverter.

18. The illuminated exit device according to claim 15 wherein the inverter is mounted in the base.

19. The illuminated exit device according to claim 15 wherein the inverter operates to provide a high voltage AC power to the electroluminescent illuminator from a low voltage input to the inverter, the low voltage not presenting a shock hazard.

* * * * *